US010247126B2

(12) United States Patent
Behrendt

(10) Patent No.: US 10,247,126 B2
(45) Date of Patent: Apr. 2, 2019

(54) FEEDBACK CONTROL METHOD FOR A FUEL DELIVERY SYSTEM

(71) Applicant: CONTINENTAL AUTOMOTIVE GmbH, Hannover (DE)

(72) Inventor: Gerald Behrendt, Frankfurt am Main (DE)

(73) Assignee: Continental Automotive GmbH, Hannover (DE)

( * ) Notice: Subject to any disclaimer, the term of this patent is extended or adjusted under 35 U.S.C. 154(b) by 0 days.

(21) Appl. No.: 15/569,692

(22) PCT Filed: Apr. 25, 2016

(86) PCT No.: PCT/EP2016/059181

§ 371 (c)(1),
(2) Date: Oct. 26, 2017

(87) PCT Pub. No.: WO2016/173986

PCT Pub. Date: Nov. 3, 2016

(65) Prior Publication Data

US 2018/0119633 A1 May 3, 2018

(30) Foreign Application Priority Data

Apr. 27, 2015 (DE) ..... 10 2015 207 672

(51) Int. Cl.

| | |
|---|---|
| ***F02D 41/30*** | (2006.01) |
| ***F02M 37/08*** | (2006.01) |
| ***F02D 33/00*** | (2006.01) |
| *F02D 41/14* | (2006.01) |
| *F02D 41/18* | (2006.01) |
| *F02D 41/24* | (2006.01) |

(52) U.S. Cl.
CPC ..... *F02D 41/3082* (2013.01); *F02D 33/006* (2013.01); *F02D 41/1454* (2013.01);
(Continued)

(58) Field of Classification Search
CPC ..... F02D 33/00; F02D 33/006; F02D 41/005; F02D 41/0052; F02D 41/30;
(Continued)

(56) References Cited

U.S. PATENT DOCUMENTS

| | | | |
|---|---|---|---|
| 6,581,574 B1 | 6/2003 | Moran et al. | |
| 6,609,501 B2 * | 8/2003 | Doane | F02D 41/3082 123/458 |

(Continued)

FOREIGN PATENT DOCUMENTS

| | | |
|---|---|---|
| DE | 44 46 277 | 6/1996 |
| DE | 100 38 565 | 2/2002 |

(Continued)

*Primary Examiner* — Hung Q Nguyen
*Assistant Examiner* — Johnny H Hoang
(74) *Attorney, Agent, or Firm* — Cozen O'Connor

(57) ABSTRACT

A feedback control method for a fuel delivery system of an internal combustion engine, having a fuel delivery pump for supplying fuel, the fuel delivery pump having a pump mechanism driven by an electric motor, which is controlled by a generated control signal. The current fuel volume delivered by the fuel delivery pump and the prevailing fuel requirement of the internal combustion engine are included in the control signal. The prevailing fuel requirement is determined using characteristic variables that characterize the operating state of the internal combustion engine.

9 Claims, 3 Drawing Sheets

(52) U.S. Cl.
CPC ..... *F02D 41/18* (2013.01); *F02D 41/2409* (2013.01); *F02D 41/2432* (2013.01); *F02D 2041/1409* (2013.01); *F02D 2200/0406* (2013.01); *F02D 2200/0414* (2013.01); *F02D 2200/0602* (2013.01); *F02D 2200/0616* (2013.01); *F02D 2200/101* (2013.01); *F02D 2200/602* (2013.01); *F02D 2250/31* (2013.01)

(58) Field of Classification Search
CPC .... F02D 41/3082; F02D 41/3836; F02D 1/00; F02D 2200/0602; F02D 2200/0604; F02D 2041/1409
USPC ..... 701/102–104, 114, 115; 123/447, 123/456–458, 495, 497
See application file for complete search history.

(56) References Cited

U.S. PATENT DOCUMENTS 8,886,441 B2 * 11/2014 Dolker ..... F02D 41/1401 701/103
2004/0200456 A1 * 10/2004 Eser ..... F02D 41/221 123/458
2005/0199219 A1 * 9/2005 Utsumi ..... F02D 41/22 123/458
2011/0000463 A1 * 1/2011 Kokotovic ..... F02D 41/042 123/457
2012/0097132 A1 * 4/2012 Suda ..... F02D 33/006 123/457
2015/0159577 A1 * 6/2015 Akita ..... F02D 41/3082 123/497

FOREIGN PATENT DOCUMENTS

| | | |
|---|---|---|
| DE | 101 37 315 | 2/2003 |
| DE | 101 55 249 | 4/2003 |
| DE | 101 62 989 | 10/2003 |
| DE | 103 03 444 | 5/2004 |
| DE | 10 2009 050468 | 4/2011 |
| DE | 10 2010 064 176 | 6/2012 |
| DE | 10 2011 077 192 | 12/2012 |
| DE | 10 2011 087 752 | 6/2013 |
| EP | 1 167 731 | 1/2002 |

* cited by examiner

FEEDBACK CONTROL METHOD FOR A FUEL DELIVERY SYSTEM

CROSS REFERENCE TO RELATED APPLICATIONS

This is a U.S. national stage of application No. PCT/EP2016/059181, filed on Apr. 25, 2016. Priority is claimed on German Application No. DE102015207672.5, filed Apr. 27, 2015, the content of which is incorporated here by reference.

BACKGROUND OF THE INVENTION

1. Field of the Invention

The invention relates to a feedback control method for a fuel delivery system of an internal combustion engine in a motor vehicle, having a fuel delivery pump for supplying the internal combustion engine with fuel, where the fuel delivery pump has a pump mechanism driven by an electric motor, where the electric motor can be controlled by a control signal, where a control signal for the control of the electric motor is generated.

2. Description of the Prior Art

The fuel delivery system in motor vehicles having an internal combustion engine must ensure an adequate delivery of fuel in a plurality of operating states of the motor vehicle, in order to ensure fault-free operation of the motor vehicle. In addition, different variants of the internal combustion engines increase the necessary flexibility here.

In order to control the fuel delivery system and in particular the fuel delivery pump, use is made of controllers, which are able to influence the volume of fuel delivered, the pressure in the fuel delivery system, and the rotational speed of the fuel delivery pump. For this purpose, the controllers must have a suitable response to setpoint changes and in particular a good response to incidents to be able to compensate adequately for disruptive influences and special situations.

Typical incidents include, for example, treading suddenly on the gas pedal and therefore abruptly increasing the fuel volume needed by the internal combustion engine. The control of the fuel delivery system must be able to compensate quickly for such a load step in order to ensure the most optimal operation possible of the internal combustion engine.

In the prior art, devices and methods for operating a fuel delivery system are known. For example, it is known to use a PID controller, which performs the control of the electric motor to ensure that fuel is provided in accordance with need. The disadvantage with the use of a simple PID controller is that the control speed and the control quality are not optimal.

Also known are methods that provide a control loop with feedback of the current value. Here, the current value determined is fed back into the controller to achieve more rapid achievement of a setpoint. As a result, the control quality and speed are increased overall but not optimally.

Also known are so-called feedforward controllers, which also incorporate further characteristic values of the motor vehicle. For example, the position of the gas pedal is taken into account. For this purpose, the signal resulting therefrom is, for example, set against the value predefined by a controller for controlling the electric motor, in order to achieve improved control. The gas pedal position can be weighted with a weighting factor which, for example, depends on rotational speed, before being set against the output value from the controller. The incorporation of the gas pedal position helps to achieve early influencing of the rotational speed of the fuel delivery pump. The disadvantage with this method is that the control of the fuel delivery pump is still not yet optimal and no optimal control result is achieved.

SUMMARY OF THE INVENTION

It is therefore an object of one aspect of the present invention to devise a method that permits optimized feedback control of the fuel delivery pump in different operating situations.

An exemplary embodiment of the invention relates to a feedback control method for a fuel delivery system of an internal combustion engine in a motor vehicle, having a fuel delivery pump for supplying the internal combustion engine with fuel, where the fuel delivery pump has a pump mechanism driven by an electric motor, where the electric motor can be controlled by a control signal, where a control signal for the control of the electric motor is generated. The current fuel volume delivered by the fuel delivery pump and the prevailing fuel requirement of the internal combustion engine are included in the control signal. The prevailing fuel requirement is determined with the aid of characteristic variables that characterize the operating state of the internal combustion engine and/or the motor vehicle.

To ensure a constant fuel supply that meets the requirements, fuel delivery systems are used in motor vehicles. In order to make a predefinition to the latter with regard to the fuel volume to be delivered, it is necessary to apply methods, which in particular permit rapid and accurate adaptation of the fuel volume to be delivered. It is particularly advantageous if both the instantaneous fuel volume delivered by the fuel delivery pump and also the currently prevailing fuel requirement of the internal combustion engine are taken into account.

If the operating state of the internal combustion engine changes, the instantaneous fuel requirement of the internal combustion engine also changes regularly. The fuel delivery pump must follow this changed fuel requirement as quickly as possible to provide an appropriate quantity of fuel again. In particular in the event of sharp changes in the operating state, such as, for example, suddenly treading fully on the gas pedal, fast and the most precise feedback control must be carried out. For this purpose, it is particularly advantageous if both the current fuel requirement of the internal combustion engine and also the currently delivered fuel volume are included in the control signal which, for example, is determined by a predefinable current intensity. From these two values, the difference can be created in a straightforward way in order to determine the delta between the instantaneous fuel requirement and the instantaneously delivered fuel volume. The instantaneous fuel requirement is particularly advantageously determined from characteristic variables that characterize the operating state of the motor vehicle and/or the internal combustion engine. In modern motor vehicles having an electrically controlled fuel supply, various characteristic variables are monitored continuously during operation in order always to ensure optimal combustion and to achieve the lowest possible fuel requirement. These characteristic variables make it possible to determine the fuel requirement directly and with an only very low time delay. Within certain limits, a prediction of the fuel requirement on the basis of the current operating state is also possible.

On account of the system, a fuel requirement caused by the operation of the internal combustion engine is detected only with a certain time delay by the fuel delivery system, which substantially comprises the fuel delivery pump and the driving electric motor. This results from the fact that the pressure measurement is often made in the vicinity of the fuel delivery pump and, because of the line lengths and the inertia of the system, a time delay cannot be avoided. In order to ensure the fastest possible feedback control that meets the requirement, it is therefore advantageous if the instantaneous fuel requirement is also included in the control of the electric motor.

Furthermore, it is advantageous if the current fuel volume delivered by the fuel delivery pump is determined from the current pressure prevailing in the fuel delivery system and the current rotational speed of the pump mechanism of the fuel delivery pump, with the aid of at least one characteristic map.

Because of the relationships between the pressure in the fuel delivery system, the rotational speed of the fuel delivery pump and the delivered fuel volume, for each fuel delivery system it is possible to determine characteristic maps that are specific to the respective fuel delivery system. Given knowledge of two of the three variables, it is thus possible at any time to draw conclusions about the respective third variable. This is particularly advantageous, since characteristic maps can be produced in a simple way and can easily be stored in the control devices used for the control of the fuel delivery system. Therefore, the determination of the respective missing variable is simply and quickly possible.

Furthermore, it is advantageous if the prevailing fuel requirement of the internal combustion engine is determined with the aid of the gas pedal position, and/or the charging pressure of a turbocharger, and/or the rotational speed of the internal combustion engine, and/or the air mass delivered, and/or the fuel/air ratio in the internal combustion engine, and/or the lambda value, and/or the air temperature.

This is particularly advantageous, since a multiplicity of the above-described characteristic variables are in any case measured continuously, which means that the instantaneous fuel requirement can be determined simply and quickly. The more different characteristic variables are recorded, the more accurately the instantaneous fuel requirement can be determined. In particular, the gas pedal position and the charging pressure of a turbocharger can also supply good indications of the fuel requirement to be expected in the near future.

It is also expedient if the current fuel volume delivered by the fuel delivery pump is determined at a time at which the delivered current fuel volume is still unchanged in comparison with an already changed fuel requirement of the internal combustion engine.

On the fuel delivery pump, changing the fuel requirement, as already described further above, manifests itself only with a time delay. This can be detected, for example, by a change in pressure in the fuel delivery system. In order to obtain a measure of the more or less fuel which must be delivered on account of the changing operating situation, it is therefore advantageous if the instantaneous fuel requirement, which is determined from the characteristic variables of the internal combustion engine, is determined when it has already changed in comparison with the starting level, while the instantaneous fuel delivery by the fuel delivery pump has not reacted thereto. As a result, the delta between current fuel requirement and currently delivered fuel volume can be determined in a simple way, and targeted adaptation of the delivery output can be carried out.

Furthermore, it is advantageous if, from the difference between the current fuel volume delivered by the fuel delivery pump and the fuel requirement of the internal combustion engine, a fuel volume setpoint to be delivered is determined, from which a rotational speed setpoint for the fuel delivery pump is determined.

On account of the above described relationships between rotational speed, pressure and volume in the fuel delivery system, the fuel volume setpoint can be converted quickly and simply into a rotational speed setpoint needed to deliver the fuel volume setpoint. The rotational speed setpoint can be adapted simply, for example via the control of the current intensity with which the electric motor is controlled.

Furthermore, it is advantageous if the fuel volume setpoint is processed with a pressure setpoint in the fuel delivery system to form the rotational speed setpoint. Because of the above-described relationships, it is particularly simple to control a fuel delivery system with the aid of characteristic maps, given knowledge of at least two or three of the variables pressure, delivery volume and rotational speed.

It is particularly advantageous if the pressure setpoint in the fuel delivery system is determined by a differential value, input into a PID controller, between a default value for the pressure and the current pressure.

A PID controller is advantageous, since it is economical and robust and permits feedback control of a controlled variable with good control quality. A default value for the pressure in the fuel delivery system can be predefined, for example on the basis of empirically determined values for specific operating situations. In modern motor vehicles, the pressure is typically predefined by the engine control unit. The pressure here is a dynamic variable, which is adapted to the different engine operating conditions and in particular to the often used high-pressure fuel injection. This default value can be adjusted via a comparison with the actually prevailing pressure. The difference results in an input signal for the PID controller, from which ultimately a control variable is generated, which is incorporated in the determination of the rotational speed setpoint of the fuel delivery pump. In an alternative refinement, another controller can also be used as a PID controller.

It is also advantageous if the fuel volume setpoint is corrected by an offset value, wherein the offset value is caused by additional elements in the fuel delivery system.

The fuel volume setpoint which is to be delivered by the fuel delivery pump can be affected with errors, depending on the configuration of the fuel delivery system. This is the case, for example, when, in addition to the main fuel delivery pump, there are also secondary pumps, such as an ejector pump. A certain fuel volume is also delivered via these secondary pumps, although this is not necessarily also delivered to the internal combustion engine. In order to measure the fuel actually delivered to the internal combustion engine as accurately as possible, it is therefore advantageous to correct these secondary pumps by an offset value. The offset value is preferably formed by a fuel volume.

A preferred exemplary embodiment is characterized in that a calibration of the fuel delivery system takes place, wherein the actual fuel volume determined by means of a characteristic map from a current rotational speed and a current pressure is put into an inverse characteristic map, wherein a comparative rotational speed and/or a comparative pressure is determined from the inverse characteristic map, wherein a deviation between the current rotational speed and the comparative rotational speed and/or the current pressure and the comparative pressure is respectively determined.

The calibration is advantageous in order to ensure the most accurate operation possible of the fuel delivery system. The calibration can be carried out with the aid of characteristic maps, wherein, for example, the fuel delivery volume is determined from the known rotational speed and the known pressure. For this purpose, a characteristic map that is specific to the fuel delivery system is used. As a result of the use of a so-called inverse characteristic map, which is produced substantially by interchanging the X axis and the Y axis of the original characteristic map, a back calculation to the pressure or the rotational speed can be carried out on the basis of the previously determined volume and respectively one of the values pressure or rotational speed. The deviations established here can be used to calibrate the fuel delivery system.

It is also to be preferred if the fuel requirement of the internal combustion engine changes before the current fuel volume delivered by the fuel delivery pump is changed.

On account of the above-described relationships, which result in particular from the length of the fuel lines and the inertia of the fuel in the lines, the fuel delivery volume of the fuel delivery pump will always change with a certain delay relative to the rising or falling instantaneous fuel requirement of the internal combustion engine.

Advantageous developments of the present invention are described in the sub-claims and in the following figure description.

BRIEF DESCRIPTION OF THE DRAWINGS

In the following, the invention will be explained in detail by using exemplary embodiments and with reference to the drawings, in which.

DETAILED DESCRIPTION OF THE PRESENTLY PREFERRED EMBODIMENTS

Figure 1:
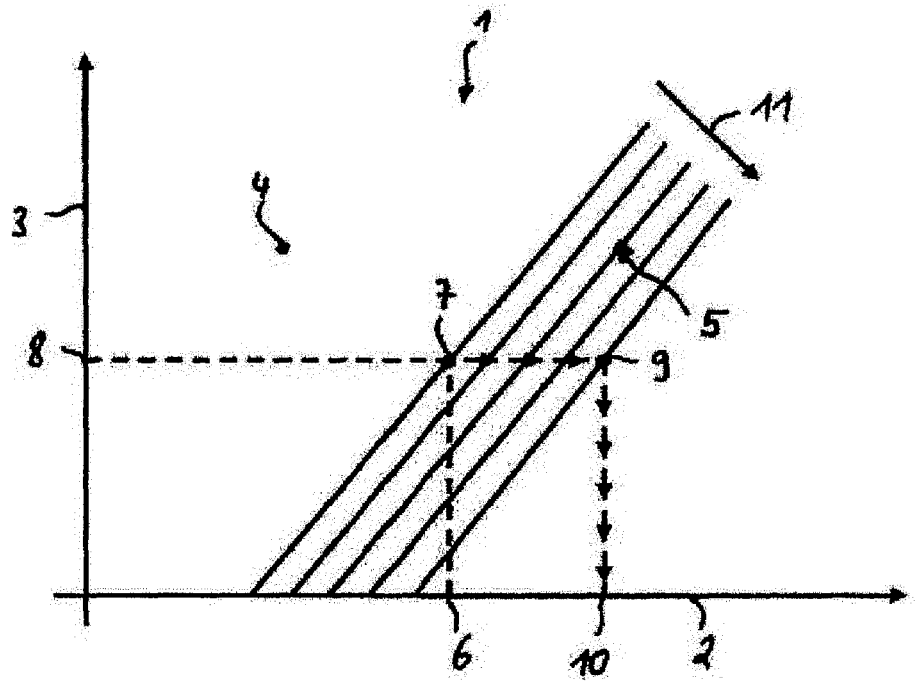
FIG. 1 is a characteristic map that represents the delivered volume over the rotational speed, curves of identical pressure being illustrated in the characteristic map.

FIG. 1 is a characteristic map 1, which represents the relationships between the volume delivered by the fuel delivery pump, the rotational speed of the fuel delivery pump and the pressure in the fuel delivery system. The rotational speed is plotted on the X axis, which is identified by the designation 2. The delivery volume of the fuel delivery pump is plotted on the Y axis, which is identified by the designation 3. In the quadrant 4 spanned by the axes 2, 3, a plurality of curves 5 are illustrated. The curves 5 are isobars and thus describe regions of constant pressure. The characteristic map 1 is specific to a specific fuel delivery system. The characteristic map changes, amongst other things, depending on the fuel delivery pump used, the lines used, and many other factors. In qualitative terms, however, the characteristic maps for the three variables described always look like the characteristic map 1 illustrated in FIG. 1.

On the basis of the characteristic map 1, given knowledge of two variables, the respective third variable can be determined. Starting from a known rotational speed which, for example, can be given by the rotational speed 6, the associated delivery volume at a known pressure 7 can be determined. Going further, a changed associated rotational speed 10 for a constant delivery volume 8 at a changed pressure 9 can also be determined. This is expedient, for example, if a known delivery volume 8 is to be delivered at an increased pressure 9, since in this way the necessary rotational speed 10 can easily be determined.

Along the arrow 11, the pressure 7, 9 in the fuel delivery system increases. For the purpose of checking and/or calibrating values, a so-called inverse characteristic map can also be used, wherein in this inverse characteristic map the X axis 2 and the Y axis 3 are interchanged with each other. For the purpose of calibration, starting from two known values, the respective missing third value can be determined. Given knowledge of the third determined value, it is then possible in the inverse characteristic map, or in reverse fashion in the characteristic map 1, for conclusions about the as yet unknown value of the three values to be drawn with the aid of a known second value. Said unknown value can then be compared with the actual measured value and, by using the difference which occurs under certain circumstances, a calibration can be carried out.

Figure 2:
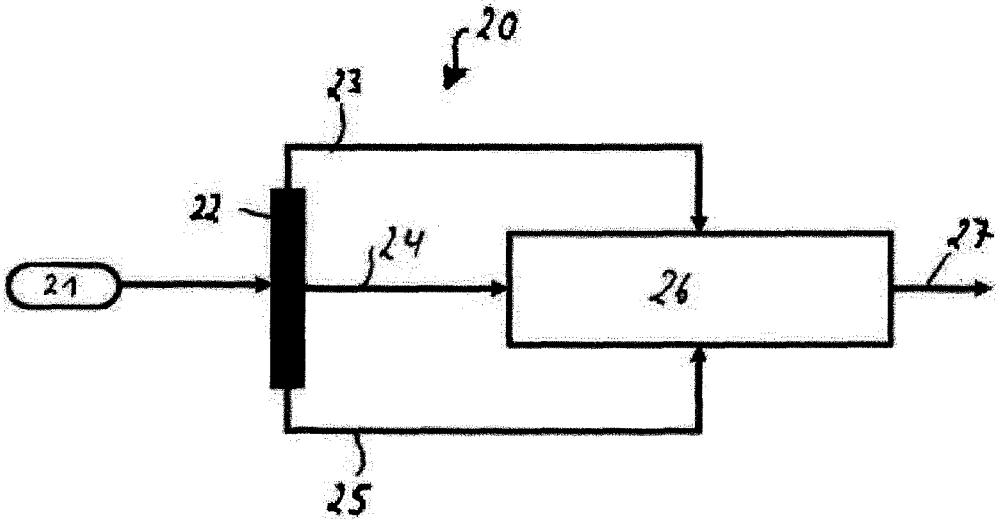
FIG. 2 is a block diagram that represents the determination of the fuel requirement of an internal combustion engine from engine-specific characteristic variables.

FIG. 2 shows a block diagram 20. Block 21 represents an interface to the rest of the vehicle. Different information in the form of characteristic variables can be taken from block 21. In the example of FIG. 2, from the distributor block 22, the characteristic value engine rotational speed is output via the signal line 23, the gas pedal position is output via the signal line 24, and the charging pressure of the turbocharger is output via the signal line 25. In alternative configurations, other values can also be used. These include in particular different temperatures, the fuel/air ratio or the measured value from the lambda probe.

Block 26 forms a so-called stoichiometry module. In block 26, on the basis of the characteristic values from block 21 and/or 22, the fuel requirement is calculated. It is possible, for example, for the minimum fuel requirement, the maximum fuel requirement, and an idling fuel requirement to be determined. All three fuel consumption rates or else only an individual fuel consumption rate can finally be passed on via the signal line 27 to following applications.

The stoichiometry module is used in particular to determine the instantaneous current fuel requirement of the internal combustion engine with the aid of characteristic values which originate directly from the operation of the internal combustion engine. By a subsequent comparison of the instantaneous fuel requirement of the internal combustion engine and the actually delivered quantity of fuel, it is possible to determine the difference, which can be used as target value for changed control of the electric motor.

Figure 3:
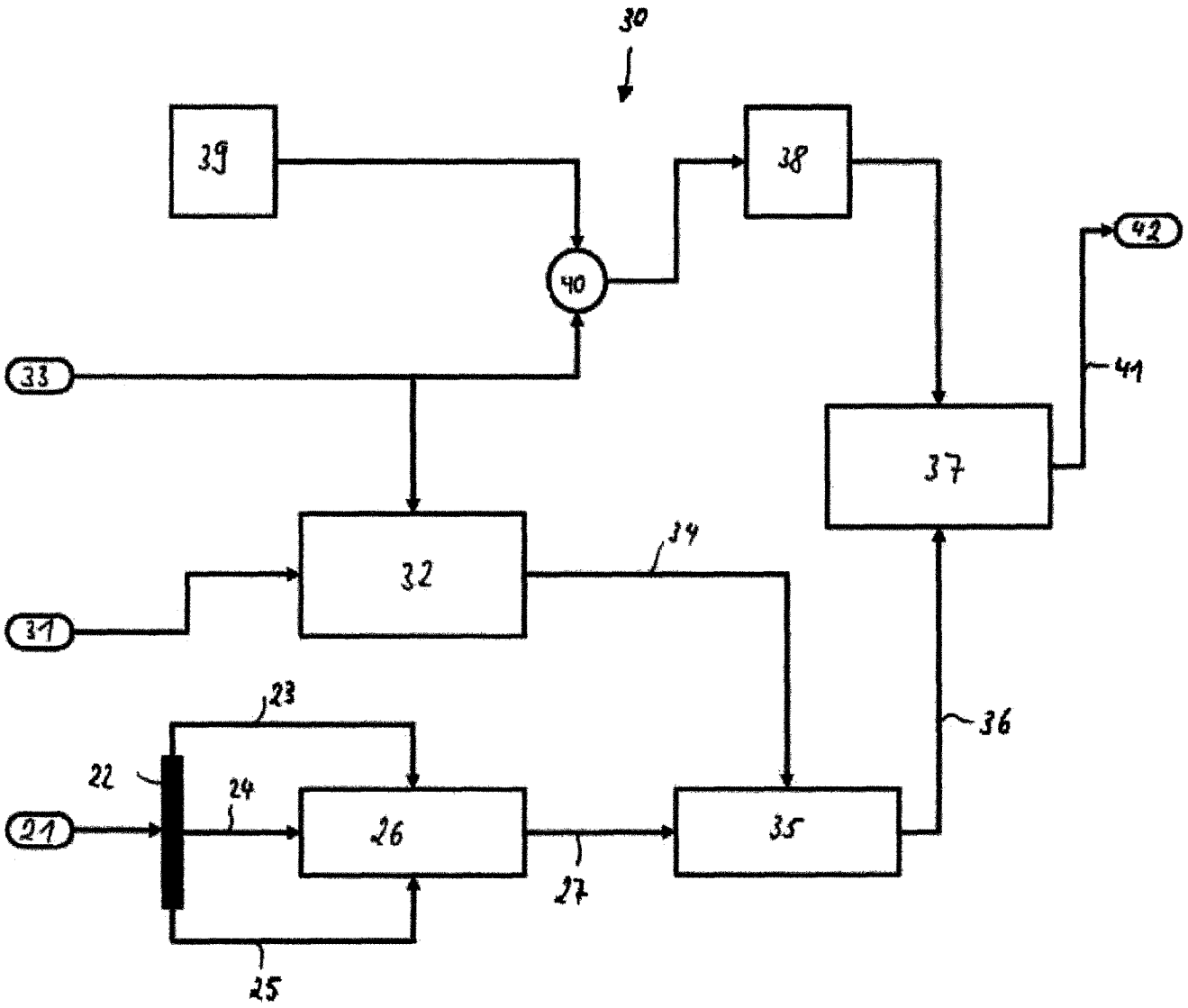
FIG. 3 is a block diagram that shows an exemplary representation of the method.

FIG. 3 shows a block diagram 30, wherein the block diagram 30 depicts an exemplary embodiment of the method according to the invention. The lower left-hand region is formed by the stoichiometry module 26 already shown in FIG. 2. The same designations are therefore used for corresponding constituents.

From block 31, the rotational speed of the fuel delivery pump is entered into the box 32, which is used to determine the fuel volume delivered by the fuel delivery pump. Also input into block 32 is a value for the pressure prevailing in the fuel delivery system, which is introduced into the block diagram via block 33. This pressure value from block 33 can be measured, for example, by a pressure sensor.

In block 32, with the aid of a characteristic map as shown, for example, in FIG. 1, the fuel volume delivered is determined as a function of the measured pressure and the associated rotational speed. The fuel volume delivered is led via signal line 34 into block 35, where the instantaneously delivered fuel volume is compared with the fuel requirement determined in block 26. The differential value generated here represents a measure of the more or less fuel needed. The differential value generated is passed on into block 37 via the signal line 36.

Also entered into block 37 is a value for the pressure setpoint in the fuel delivery system, weighted by a controller 38, in particular a PID controller. Said pressure setpoint is determined from a default value 39 entered into the block diagram, in that, in a differential block 40, the default value 39 is set against the value originating from block 33 of the pressure prevailing in the fuel delivery system. The difference from the differential block 40 is entered into the controller 38, wherein the value is weighted in accordance with a defined algorithm or default values predefined externally. In an alternative configuration, the default value 39 can also be predefined externally without undergoing any further correction.

In block 37, finally, by using the weighted pressure value from the controller 38 and the differential value of the fuel volume determined in block 35, a default rotational speed is determined for the fuel delivery pump. The default rotational speed is output to block 42 via signal line 41.

In block 37, it is possible to use a characteristic map, as is already used for example in block 32. In addition, predefined algorithms can be used to determine the rotational speed setpoint or a default rotational speed.

In alternative developments, the individual blocks can also be interlinked further with one another, so that, for example, the function of the controller in block 38 depends on the results determined in other blocks. In this way, the control quality can be increased considerably.

The different features of the individual exemplary embodiments can also be combined with one another.

The exemplary embodiments of FIGS. 1 to 3 in particular have no restrictive character and are used to illustrate the idea of the invention. In particular, FIG. 3 shows only one possible configuration of the method according to the invention, without ruling out other alternatives covered by the protective scope of the claims.

Figure 4:
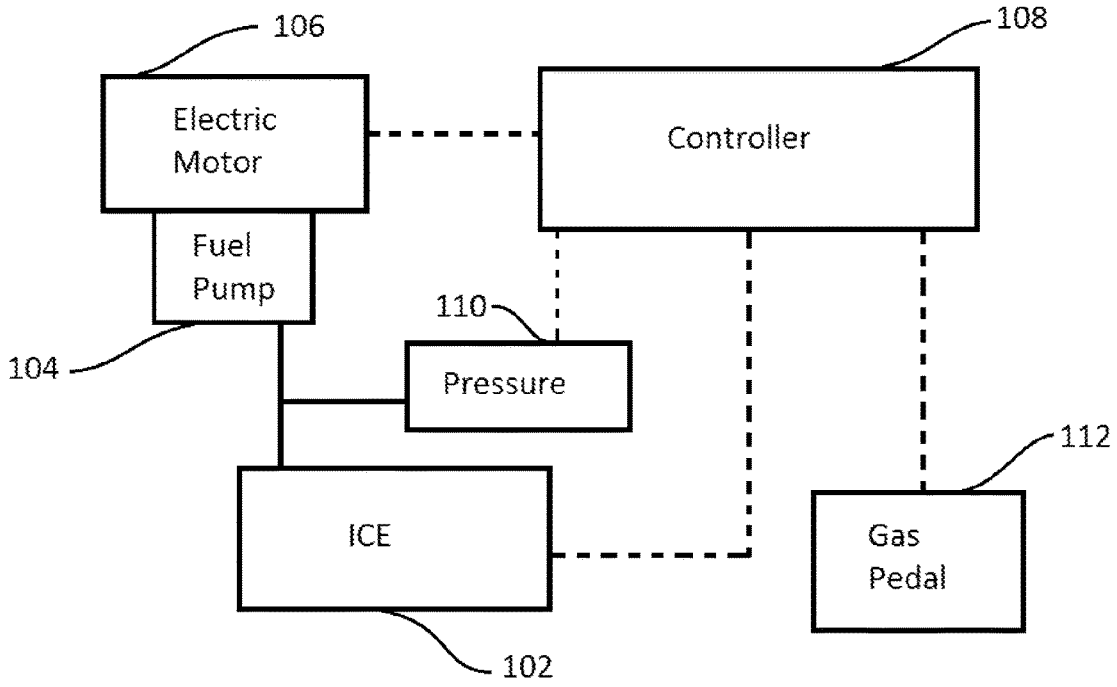
FIG. 4 is a block diagram of a fuel delivery system of an internal combustion engine.

FIG. 4 is a block diagram of a fuel delivery system of an internal combustion engine 102. A fuel delivery system of the internal combustion engine has a fuel delivery pump 104 for supplying fuel, the fuel delivery pump 104 has a pump mechanism driven by an electric motor 106, which is controlled by a generated control signal in a controller 108. The current fuel volume delivered by the fuel delivery pump 104 and the prevailing fuel requirement of the internal combustion engine are included in the control signal. The prevailing fuel requirement is determined using characteristic variables that characterize the operating state of the internal combustion engine which can include one or more of a pressure measured by a pressure sensor 110 and a position of a gas pedal 112.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A feedback control method for a fuel delivery system of an internal combustion engine in a motor vehicle, having a fuel delivery pump that supplies the internal combustion engine with fuel, the fuel delivery pump has a pump mechanism driven by an electric motor, the electric motor controlled by a control signal, comprising:

generating the control signal for the electric motor, wherein a current fuel volume delivered by the fuel delivery pump and a prevailing fuel requirement of the internal combustion engine are included in determining the control signal;

determining the prevailing fuel requirement based at least in part on characteristic variables that characterize an operating state of at least one of the internal combustion engine and the motor vehicle; and calibrating the fuel delivery system, by:

determining the actual fuel volume by a characteristic map using a current rotational speed and a current pressure applied to an inverse characteristic map;

determining at least one of a comparative rotational speed and a comparative pressure from the inverse characteristic map; and determining a deviation between at least one of:

the current rotational speed and the comparative rotational speed and the current pressure and the comparative pressure.

2. The method as claimed in claim 1, further comprising:

determining the current fuel volume delivered by the fuel delivery pump from a current pressure prevailing in the fuel delivery system and a current rotational speed of the pump mechanism of the fuel delivery pump based at least in part on at least one characteristic map.

3. The method as claimed in claim 2, further comprising:

determining the prevailing fuel requirement of the internal combustion engine based at least in part on at least one of:

a gas pedal position, a charging pressure of a turbocharger, a rotational speed of the internal combustion engine, a delivered air mass, a fuel/air ratio in the internal combustion engine, a lambda value, and an air temperature.

4. The method as claimed in claim 1, wherein the current fuel volume delivered by the fuel delivery pump is determined at a time at which a delivered current fuel volume is still unchanged in comparison with an already changed fuel requirement of the internal combustion engine.

5. The method as claimed in claim 4, further comprising:

determining a fuel volume setpoint to be delivered from a difference between the current fuel volume delivered by the fuel delivery pump and the fuel requirement of the internal combustion engine; and determining a rotational speed setpoint for the fuel delivery pump from the a fuel volume setpoint.

6. The method as claimed in claim 5, wherein the fuel volume setpoint is processed with a pressure setpoint in the fuel delivery system to form the rotational speed setpoint.

7. The method as claimed in claim 6, wherein the pressure setpoint in the fuel delivery system is determined by a differential value, input into a PID controller, between a default value for the pressure and a current pressure.

8. The method as claimed in claim 5, further comprising:

correcting the fuel volume setpoint by an offset value, wherein the offset value is caused by additional elements in the fuel delivery system.

9. The method as claimed in claim 4, wherein the fuel requirement of the internal combustion engine changes before the current fuel volume delivered by the fuel delivery pump is changed.

* * * * *